US005170808A

United States Patent [19]

Vild

[11] Patent Number: 5,170,808

[45] Date of Patent: Dec. 15, 1992

[54] ACID PERM METHOD

[76] Inventor: Patricia A. Vild, 2803 Washington Ave., Erie, Pa. 16508

[21] Appl. No.: 229,818

[22] Filed: Aug. 8, 1988

[51] Int. Cl.[5] ..... A45D 7/00

[52] U.S. Cl. ..... 132/210; 132/319

[58] Field of Search ..... 132/200–212, 132/319; 40/586; 2/174, 410, 9–12, 181, 195, 198, 197, 199

[56] References Cited

U.S. PATENT DOCUMENTS

| | | | |
|---|---|---|---|
| 1,764,912 | 6/1930 | Caster-Udell | 132/212 |
| 2,033,691 | 3/1936 | Douglass | 2/174 |
| 2,241,855 | 5/1941 | Heisterberg | 132/212 |
| 3,167,785 | 2/1965 | Uhl | 2/174 |
| 3,348,240 | 10/1967 | Kohn | 2/174 |
| 4,547,903 | 10/1985 | Brown et al. | 2/199 |
| 4,656,671 | 4/1987 | Manges | 2/174 |

*Primary Examiner*—Kenneth J. Dorner
*Assistant Examiner*—Brian K. Green
*Attorney, Agent, or Firm*—Ralph Hammar

[57] ABSTRACT

In acid perms, the moist hair while still wet from a shampoo is wound around curling rods and saturated with an acid perm solution. A band or strip of absorbent cotton is placed across the forehead below the hair line. The rim of a visor is mounted on the band and held in place by the lower end of a plastic bag tightened around the head and fastened in place. A preheated hair dryer is lowered over the bag and the heat from the dryer releases acid fumes which are held in contact with the hair until the perm is set. The band absorbs any seepage. The visor protects the eyes from acid fumes. Result: a better perm with no skin or eye irritation.

1 Claim, 1 Drawing Sheet

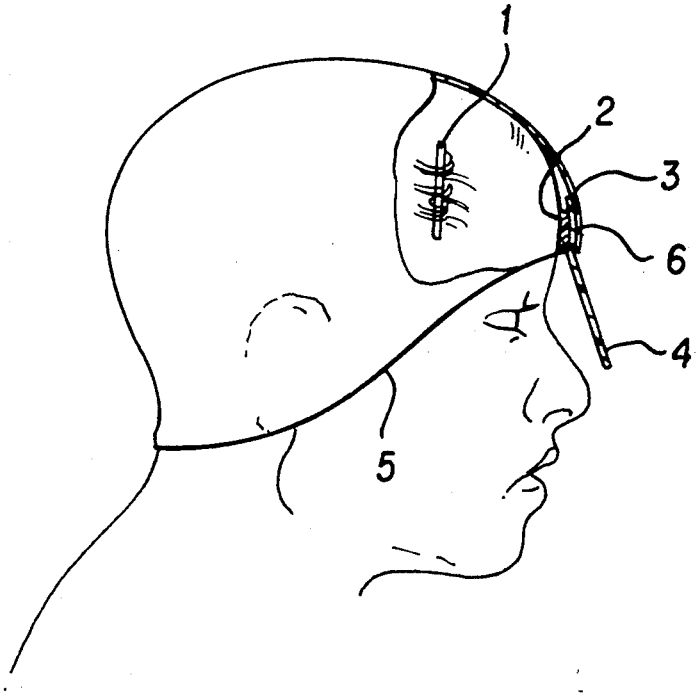
1
2
3
6
4
5

ACID PERM METHOD

BACKGROUND OF THE INVENTION

Heat activated acid solutions produce better permanent waves and less hair damage but are uncomfortable due to the heat and acid vapors which irritate the eyes, particularly wearers of contact lenses.

SUMMARY OF THE INVENTION

This invention is a method which reduces the discomfort while retaining the advantages of the acid perm.

BRIEF DESCRIPTION OF THE DRAWINGS

In the drawing, the single FIGURE shows a perm in process and the method for decreasing the discomfort from heat and fumes.

DESCRIPTION OF THE PREFERRED EMBODIMENT

While the hair is still wet from the shampoo and without a towel dry or drying under dryer, the moist hair is wrapped around rods 1 or other curling devices and lightly remoistened if the hair should become dry. A band or strip 2 of cotton or similar absorbent material is placed around the hairline and the dryer is turned to the hot position to preheat.

The acid perm lotion is thoroughly mixed and is applied to the hair in two applications, a light application first to all rods and then, more freely, a second application to each rod to insure uniform penetration.

The rim 3 of visor 4 is mounted on the band 2 and the open end 5 of a plastic bag 6 is lowered over the head and fastened in place over the band 2 and rim 3 of the visor.

The preheated dryer is now lowered over the head and the heat from the dryer is transmitted through the plastic bag to activate the solution on the hair and release the acid fumes which are retained in contact with the hair by the plastic bag 6. The visor keeps the fumes and heat away from the client's face and eyes and prevents irritation of the eyes, a feature of great importance to wearers of contact lenses who can wear contacts without irritation from fumes of the perm solution and do not have any dryness of the eyes due to the blocking of the heat and fumes from the dryer. Clients who do not wear contacts can better bear the heat of the dryer because they do not have the fumes or heat blowing in their faces or eyes.

In from five to ten minutes, and every three minutes thereafter, the bag is opened to check the progress of the permanent operation. The total processing time ranges from ten to twenty-five minutes and sometimes longer if a stronger hair pattern is desired.

When the permanent operation is over, the bag 6, cotton band 2 and visor 4 are removed and the hair is rinsed in warm water for about three minutes. The hair is then blotted and allowed to stand for five minutes before applying a neutralizer to the hair. The neutralizer is applied twice to all rods, in the same manner as the application of the curling lotion. After five minutes the rods are removed and the neutralizer worked through the hair. The hair is then rinsed again with warm water for two minutes and is ready for styling.

Several expedients may be used for fastening the rim 3 of the visor. The rim may be coated with a pressure sensitive adhesive which adheres to the absorbent cotton band 2. The open end of the plastic bag 6 may be provided with a drawstring or may be elasticized or provided with a separate elastic for holding the rim to the band.

I claim:

1. The method of permanent waving or making a perm with a heat activated acid solution applied to hair wrapped on rods and other curling devices which comprises wrapping an absorbent cotton band around the head at the hairline and above the eyes to absorb seepage of solution to the skin, applying a visor having a rim with the rim of the visor overlying the band on the forehead and the balance of the visor projecting from the forehead over the eyes to deflect fumes and heat away from the eyes, and applying a plastic bag having an open end and a closed end over the hair with the open end of the bag overlying the absorbent band and the rim of the visor and with the closed end of the bag enclosing the hair to hold in contact with the hair the fumes of the solution generated when a preheated hair drying hood is lowered over the bag to activate the solution and to maintain the hair heated until the perm is set.

* * * * *